US010719048B2

(12) United States Patent
Huang

(10) Patent No.: US 10,719,048 B2
(45) Date of Patent: Jul. 21, 2020

(54) IMAGE FORMING APPARATUS

(71) Applicant: AVISION INC., Hsinchu (TW)

(72) Inventor: Min-Tung Huang, Hsinchu (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 16/396,532

(22) Filed: Apr. 26, 2019

(65) Prior Publication Data

US 2020/0004196 A1 Jan. 2, 2020

(30) Foreign Application Priority Data

Jun. 29, 2018 (TW) ..... 107122687 A

(51) Int. Cl.
*G03G 15/00* (2006.01)
*G03G 21/16* (2006.01)

(52) U.S. Cl.
CPC ..... *G03G 21/1628* (2013.01)

(58) Field of Classification Search
CPC ..... G03G 21/1628; G03G 21/1633; G03G 21/1647; G03G 21/1821; G03G 21/1842; G03G 21/1853; G03G 2221/1654
USPC ..... 399/107, 110, 111, 116, 117, 125
See application file for complete search history.

(56) References Cited

U.S. PATENT DOCUMENTS 7,778,567 B2 * 8/2010 Igarashi ..... G03G 15/0178 399/110
8,068,767 B2 * 11/2011 Kamimura ..... G03G 15/081 399/167
9,170,560 B2 * 10/2015 Hattori ..... G03G 21/1647

* cited by examiner

*Primary Examiner* — Hoan H Tran
(74) *Attorney, Agent, or Firm* — Maschoff Brennan

(57) ABSTRACT

The disclosure provides an image forming apparatus for accommodating photosensitive assembly having first assembly shaft. The image forming apparatus includes casing, fixing mechanism and cover plate. The casing has first guide groove, and the first assembly shaft is configured to be slidably disposed in the first guide groove. The fixing mechanism is movably mounted on the casing so as to be movable between a blocking state and a releasing state. The cover plate is movably connected the casing so as to be movable between an opened position and a closed position. When the cover plate is moved to the closed position, the cover plate forces the fixing mechanism to move to the blocking state to block the first guide groove and cover a bottom surface of the first guide groove so as to retain the first assembly shaft of the photosensitive assembly between the fixing mechanism and the bottom surface.

10 Claims, 7 Drawing Sheets

IMAGE FORMING APPARATUS

CROSS-REFERENCE TO RELATED APPLICATIONS

This non-provisional application claims priority under 35 U.S.C. § 119(a) on Patent Application No(s). 107122687 filed in R.O.C. Taiwan on Jun. 29, 2018, the entire contents of which are hereby incorporated by reference.

TECHNICAL FIELD

The disclosure relates to an image forming apparatus, more particularly to an imaging apparatus having a fixing mechanism.

BACKGROUND

Multifunction product (MFP)/Printer is a network-attached document production device that combines two or more of the copy, print, scan and fax functions. Generally, the printer contains a photosensitive assembly which is consisted of a photoconductive drum and a toner cartridge. The photoconductive drum is a photoconductor which can be charged to attract toner particles by way of electrostatic polarities, and then the toner particles can be fused or melted to the paper by a heating module. It is understood that the photosensitive assembly is consumable, thus the printer usually allows user to replace and install the photoconductive drum and the toner cartridge.

SUMMARY

One embodiment of the disclosure provides an image forming apparatus which is configured for accommodating at least one photosensitive assembly having at least one first assembly shaft. The image forming apparatus includes a casing, at least one fixing mechanism and a cover plate. The casing has at least one first guide groove, and the at least one first assembly shaft is configured to be slidably disposed in the at least one first guide groove. The at least one fixing mechanism is movably mounted on the casing so as to be movable between a blocking state and a releasing state. The cover plate is movably connected the casing so as to be movable between an opened position and a closed position. When the cover plate is moved to the closed position, the cover plate forces the at least one fixing mechanism to move to the blocking state to block the at least one first guide groove and cover bottom surface of the at least one first guide groove so as to retain the at least one first assembly shaft of the at least one photosensitive assembly between the at least one fixing mechanism and the bottom surface. When the cover plate is moved to the opened position from the closed position, the movement of the cover plate allows the at least one fixing mechanism to move toward the releasing state from the blocking state so as to expose the at least one first guide groove of the casing

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
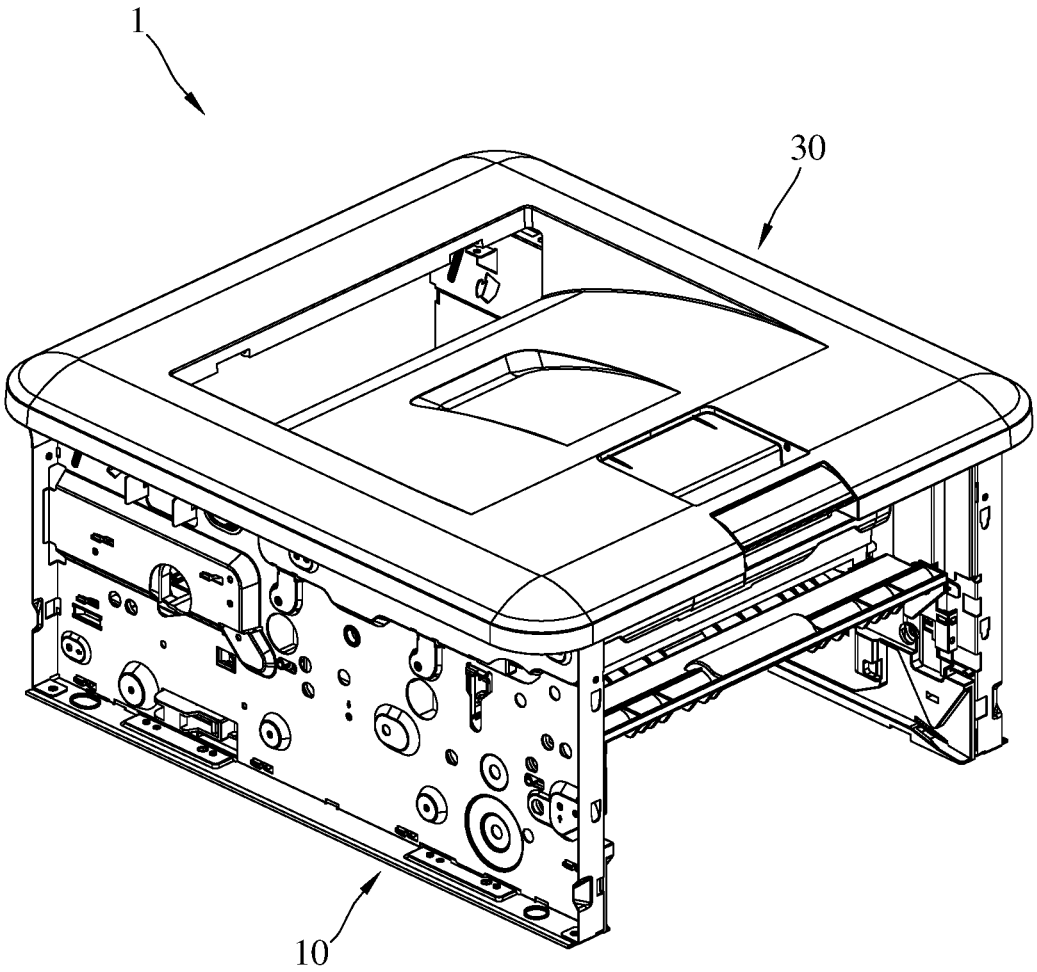
FIG. 1 is a perspective view of an image forming apparatus according to one embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known main structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure. Furthermore, in order to simplify the drawings, some conventional structures and components are drawn in a simplified manner to keep the drawings clean.

Figure 2:
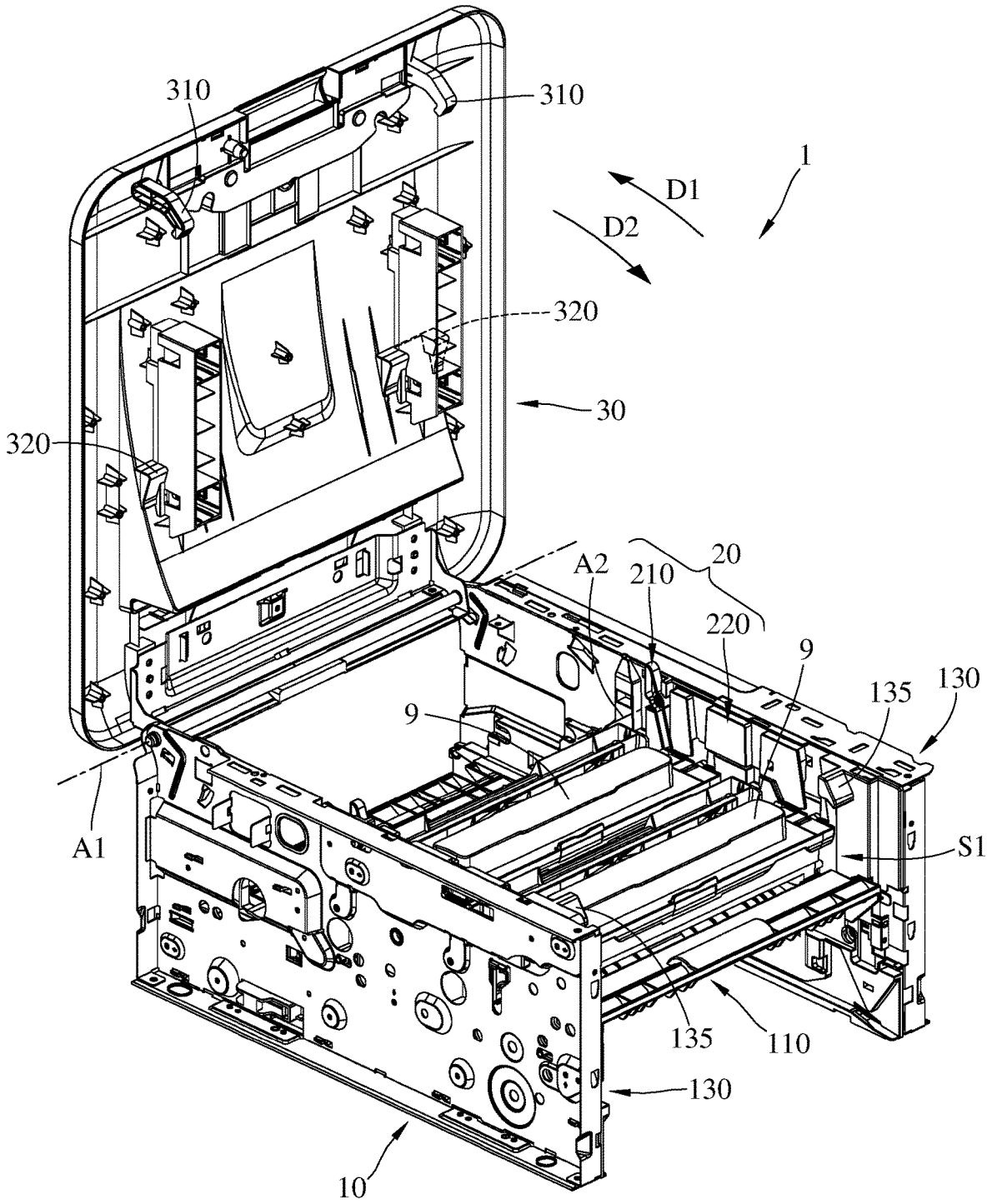
FIG. 2 is a perspective view of the image forming apparatus in FIG. 1 where a cover plate is opened to an opened position.

Firstly, please refer to FIGS. 1-2, FIG. 1 is a perspective view of an image forming apparatus according to one embodiment of the present disclosure, and FIG. 2 is a perspective view of the image forming apparatus in FIG. 1 where a cover plate is opened to an opened position. This embodiment provides an image forming apparatus 1. The image forming apparatus 1 is adapted to be installed into, for example, a printer or a multifunction product (MFP), and is able to accommodate one or more photosensitive assemblies 9. As shown in FIG. 2, the image forming apparatus 1 is able to accommodate two photosensitive assemblies 9 at the same time. The photosensitive assembly 9 used herein is an assembly that is consisted of a photoconductive drum, a toner cartridge and a supporting case etc. (all not numbered). In addition, these two photosensitive assemblies 9 are similar in configuration, and the only difference between them may be the color of the toner inside the toner cartridges. However, the present disclosure is not limited by the quantity of the photosensitive assemblies 9 that the image forming apparatus 1 can accommodate or the color of the toner stored in the toner cartridges.

Figure 3:
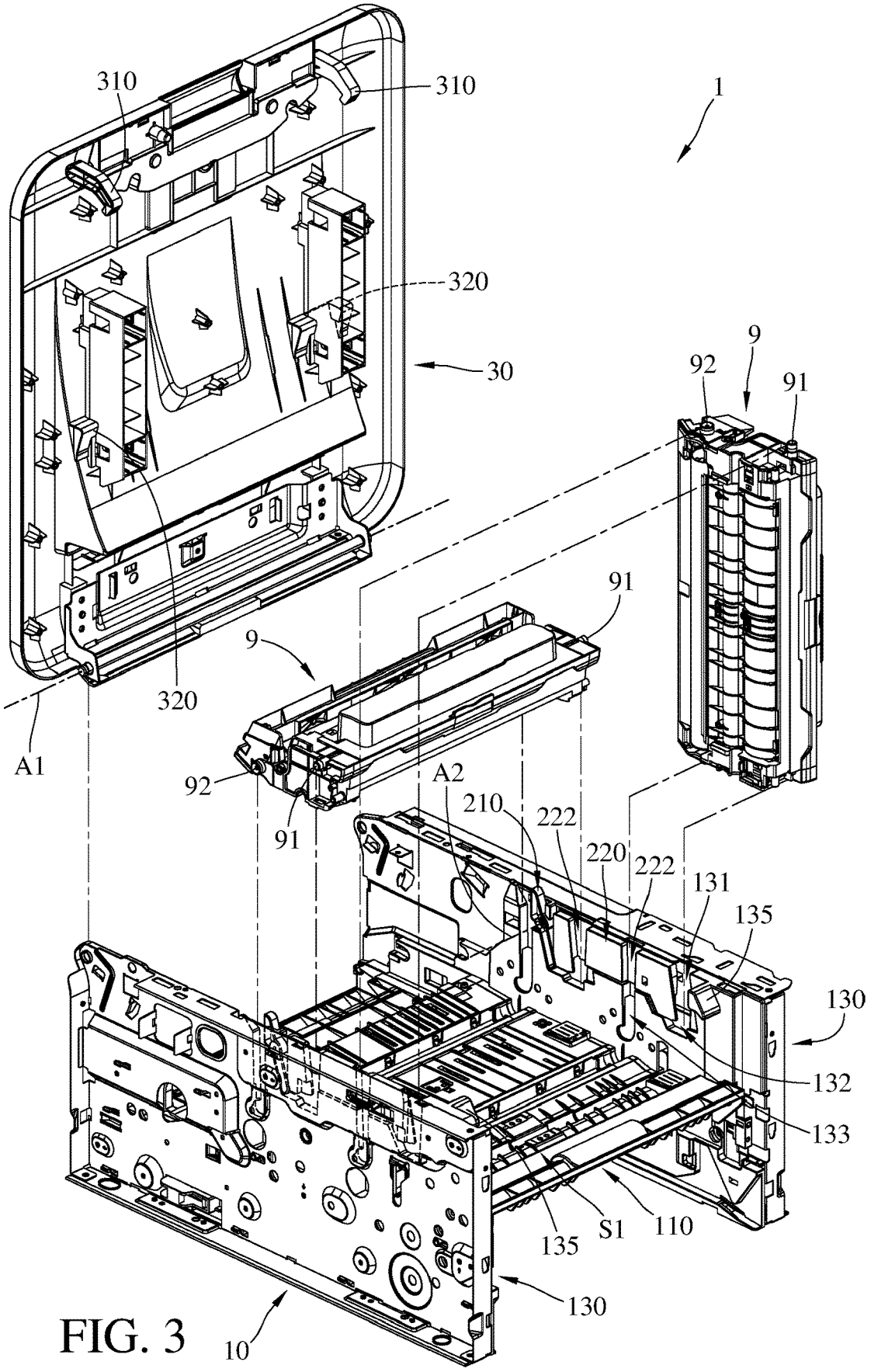
FIG. 3 is an exploded view of the image forming apparatus in FIG. 2.
Figure 4:
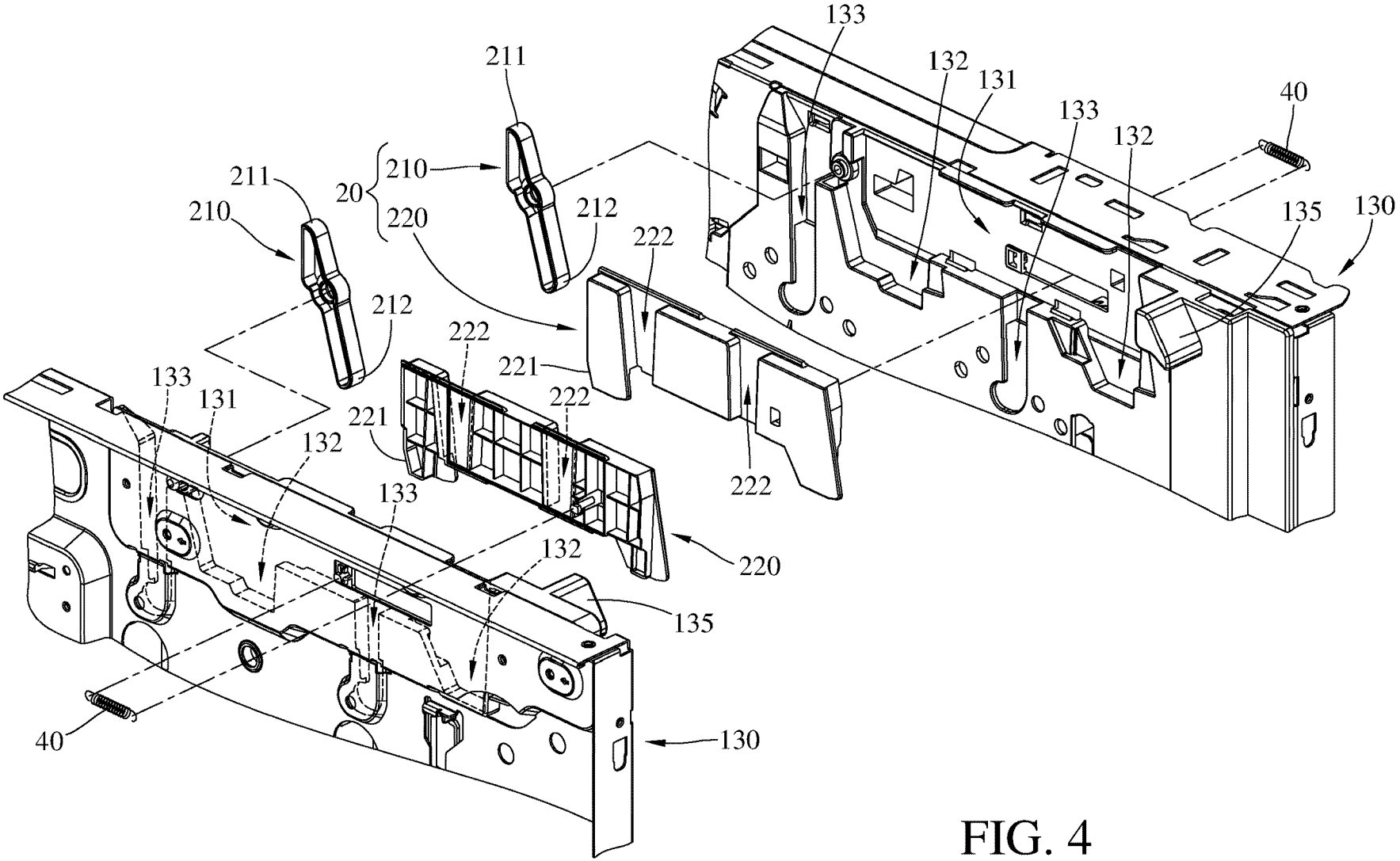
FIG. 4 is a partial enlarged exploded view of the image forming apparatus in FIG. 2.
Figure 5:
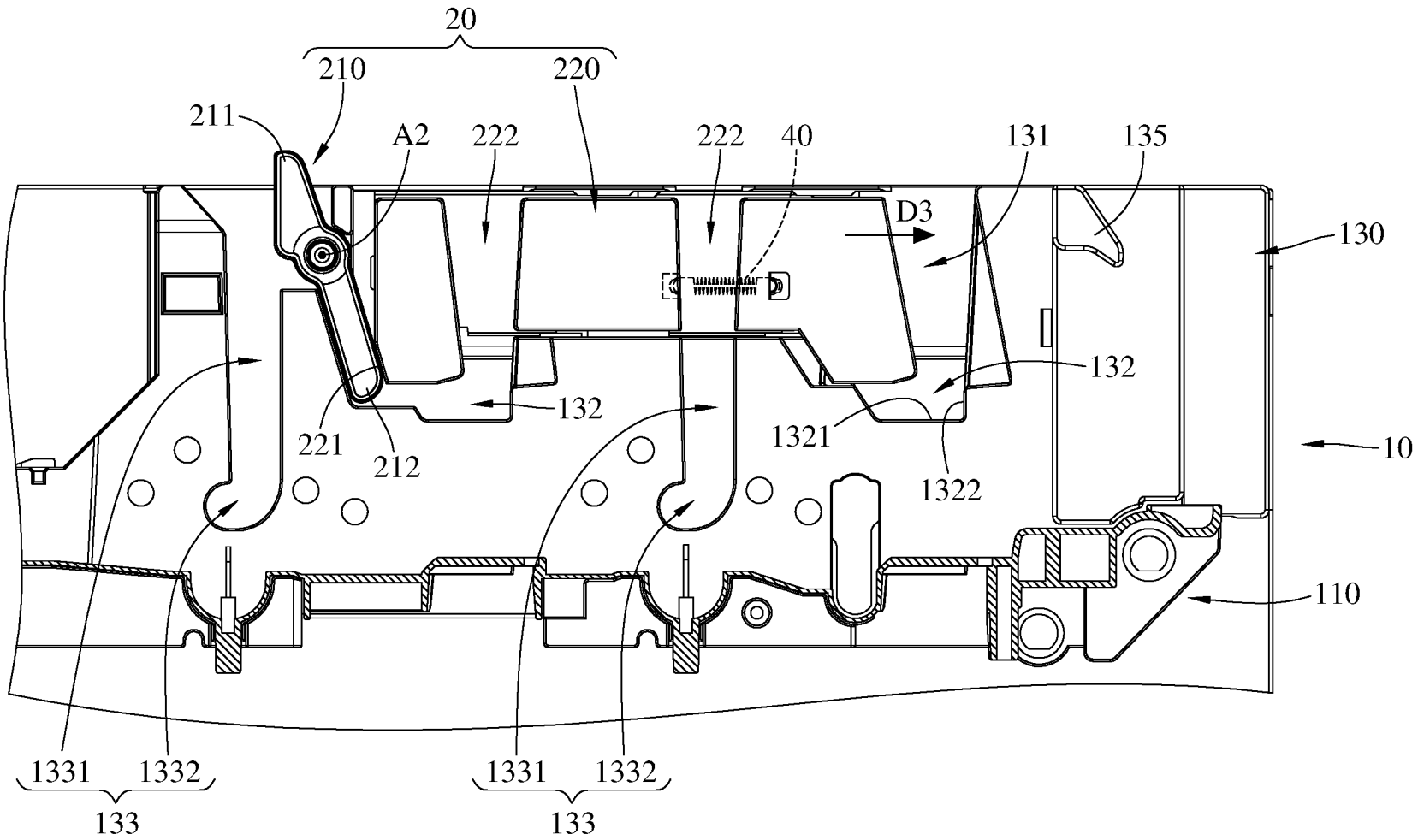
FIG. 5 is a partial enlarged side view of the image forming apparatus in FIG. 2.

Then, please further refer to FIGS. 3-5, FIG. 3 is an exploded view of the image forming apparatus in FIG. 2, FIG. 4 is a partial enlarged exploded view of the image forming apparatus in FIG. 2, and FIG. 5 is a partial enlarged side view of the image forming apparatus in FIG. 2. In this embodiment, the image forming apparatus 1 includes a casing 10, two fixing mechanisms 20 and a cover plate 30.

The casing 10 includes a base plate 110 and two side plates 130. The two side plates 130 are respectively mounted to two opposite sides of the base plate 110 so that the side plates 130 and the base plate 110 together form an accommodating space S1 therebetween for accommodating the aforementioned photosensitive assemblies 9.

Two opposite sides of the cover plate 30 are respectively pivotally coupled to the two side plates 130 of the casing 10, therefore the cover plate 30 is pivotable between an opened position (as shown in FIG. 2) and a closed position (as shown in FIG. 1) about a first axis A1. As shown in the figures, the cover plate 30 is able to be pivoted to the opened position along a first direction D1, or is able to be pivoted to the closed position along a second direction D2 which is opposite to the first direction D1. Additionally, the cover plate 30 has a pair of hooks 310 which is located at a side of the cover plate 30 away from the first axis A1. The hooks 310 are configured to respectively engage with a pair of cover locks 135 that are respectively located on sides of the side plates 130 away from the first axis A1. Further, the user is able to move a movable component on the front edge of the cover plate 30 (as shown in FIG. 1 or 2 but not numbered) so as to move the hooks 310. The so-called "closed position" means that the cover plate 30 is in a position that the hooks 310 respectively engage to the cover locks 135 on the side plates 130. The so-called "opened position" means that the cover plate 30 is in a position that the hooks 310 are disengaged from the cover locks 135. Moreover, the cover plate 30 further has a pair of press blocks 320 which protrude from the cover plate 30 and is located between the first axis A1 and the hooks 310.

Then, please see FIG. 4 to further describe the configuration of the side plate 130. It is noted that the two side plates 130 are similar and mirror to each other symmetrically, thus only one of the side plates 130 is described in detail in the following paragraphs.

In this embodiment, the side plate 130 has a first slide groove 131, two first guide grooves 132 and two second guide grooves 133 on its inner surface. The first slide groove 131 is located close to a side of the side plate 130 away from the base plate 110 and substantially extends along a long side of the side plate 130. The two first guide grooves 132 are connected to a side of the first slide groove 131 facing the base plate 110 and extend toward the base plate 110. One of the second guide grooves 133 is located between the two first guide grooves 132 and extends toward the base plate 110 from the side of the first slide groove 131 facing the base plate 110, and the other second guide groove 133 is located at an end of the first slide groove 131 close to the first axis A1 and extends toward the base plate 110. As shown in the figures, one of the first guide grooves 132 is located between the two second guide grooves 133.

In this embodiment, the first guide grooves 132 and the second guide grooves 133 are divided into two groups, and each group is consisted of one first guide groove 132 and one second guide groove 133. One of the groups is relatively close to the first axis A1, and the other is relatively away from the first axis A1. These two groups respectively correspond to the aforementioned photosensitive assemblies 9. Furthermore, as shown in FIG. 4, the side of the first slide groove 131 opposite to the first guide grooves 132 and the second guide grooves 133 is not covered; that is, the first guide grooves 132 and the second guide grooves 133 are exposed from the side of the side plate 130 away from the base plate 110. Therefore, the first assembly shaft 91 and the second assembly shaft 92 of the photosensitive assembly 9 can be installed into the first guide groove 132 and the second guide groove 133 of one of the groups via the first slide groove 131.

Then, as shown in FIG. 5, each first guide groove 132 has a bottom surface 1321 and a guide surface 1322 which are connected to each other. From the view of FIG. 5, the bottom surface 1321 is horizontal, and the guide surface 1322 is connected to a side of the bottom surface 1321. The guide surface 1322 is configured to guide the first assembly shaft 91 of the photosensitive assembly 9 so that the first assembly shaft 91 can slide along the guide surface 1322 and therefore reaching the bottom surface 1321, the detail of which will be well explained later. In addition, each second guide groove 133 has a straight portion 1331 and a curved portion 1332 which are connected to each other. From the view of FIG. 5, the straight portion 1331 vertically extends downward from the first slide groove 131, and the curved portion 1332 is connected to a side of the straight portion 1331 away from the top edge and extends in a direction away from the first guide groove 132. When the second assembly shaft 92 of the photosensitive assembly 9 is installed into the second guide groove 133, the straight portion 1331 is able to guide the second assembly shaft 92 so that the second assembly shaft 92 can slide into the curved portion 1332 and therefore being stopped by a side of the curved portion 1332 away from the first guide groove 132, the detail of which will be well explained later.

Then, please refer to FIGS. 2-5 to further describe the configuration of the fixing mechanism 20. It is noted that the two fixing mechanisms 20 are similar and mirror to each other symmetrically, thus only one of the fixing mechanisms 20 is described in detail in the following paragraphs.

Figure 6:
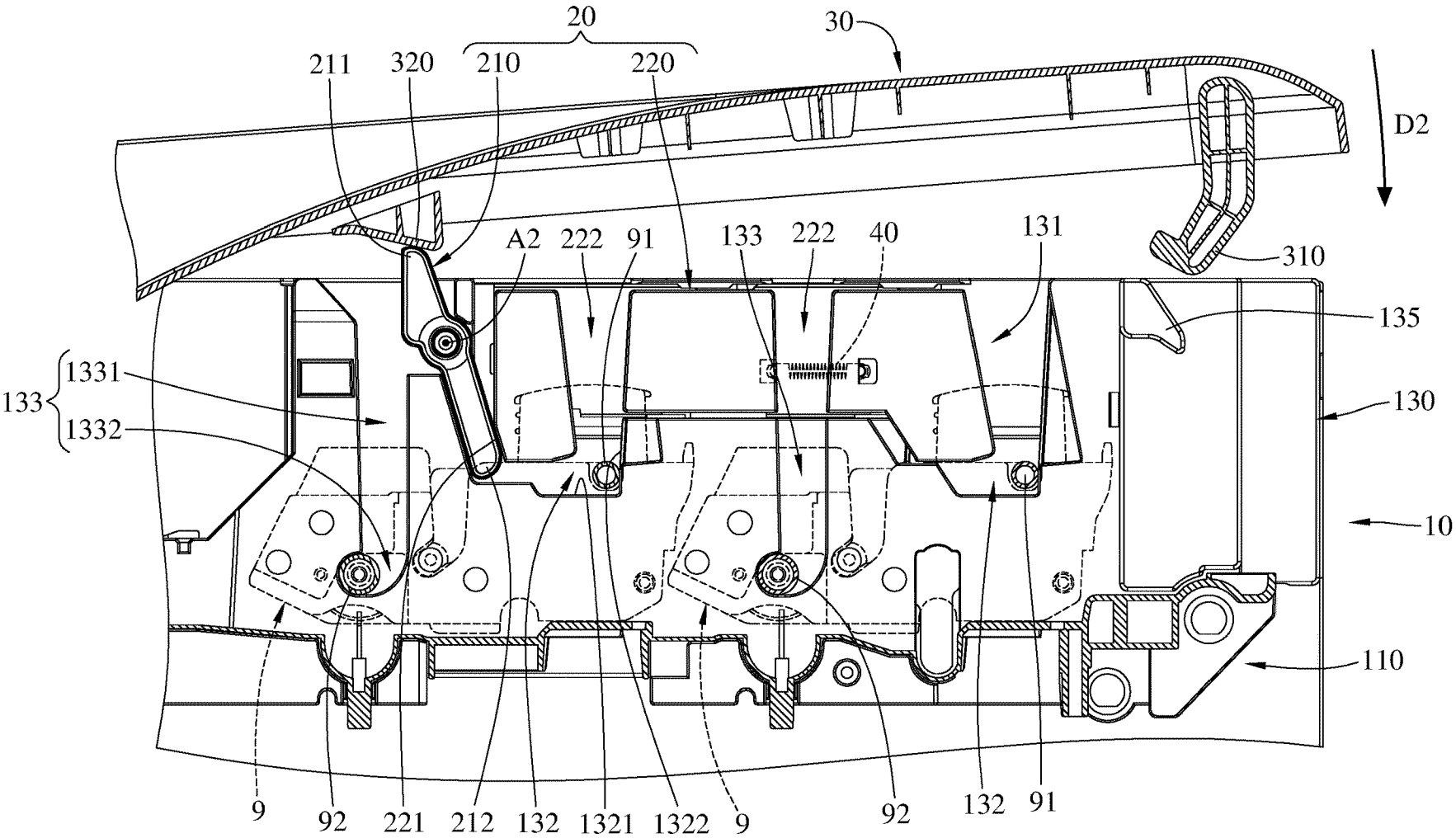
FIGS. 6-7 are partial enlarged side views of the image forming in FIG. 1 showing the operation of the imaging apparatus.
Figure 7:
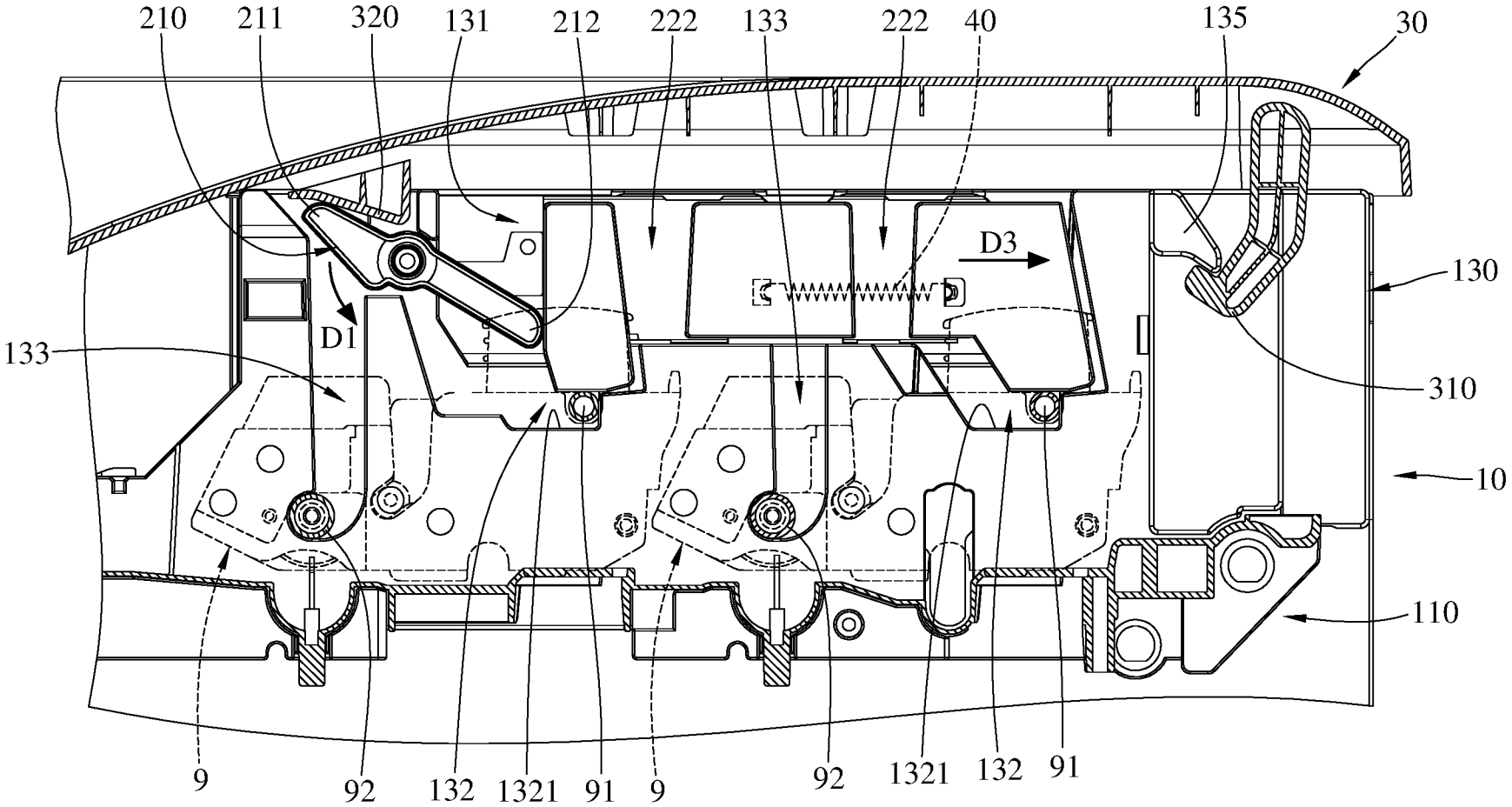

The fixing mechanisms 20 are movably respectively mounted to the side plates 130 so that each of them is able to be movable between a blocking state (as shown in FIG. 7) and a releasing state (as shown in FIG. 6). In this embodiment, each fixing mechanism 20 includes a trigger 210 and a stopper 220.

In each fixing mechanism 20, the trigger 210 is pivotally mounted on a side of the first slide groove 131 close to the first axis A1 about a second axis A2. The trigger 210 has an engage end 211 and a pushing end 212 opposite to each other, and the second axis A2 is located between the engage end 211 and the pushing end 212. The engage end 211 of the trigger 210 normally sticks out past the top edge of the side plate 130 and is configured to be pressed by one of the press blocks 320 of the cover plate 30 when the cover plate 30 is moved to the closed position (as shown in FIGS. 6-7).

The stopper 220 is slidably disposed in the first slide groove 131 of the side plate 130 and slidable along, for example, a direction D3. The pushing end 212 of the trigger 210 constantly contacts a side of the stopper 220 facing the first axis A1. In more detail, the stopper 220 has a contact inclined surface 221 located on a side of the stopper 220 facing the trigger 210, and the contact inclined surface 221 is configured to contact the pushing end 212 of the trigger 210. While the fixing mechanism 20 is moved from the releasing state (FIG. 5), the pivot direction of the trigger 210 is, for example, orthogonal to the contact inclined surface 221, which helps the pushing end 212 to push the stopper 220 to slide. In addition, the stopper 220 has two third guide grooves 222. According to the movement of the stopper 220, the two third guide grooves 222 can be respectively aligned with one of the second guide grooves 133 and one of the first guide grooves 132 or can be offset from the second guide grooves 133 and the first guide grooves 132. When the two third guide grooves 222 are respectively aligned with one of the second guide grooves 133 and one of the first guide grooves 132 (as shown in FIG. 5), the first guide grooves 132 and the second guide grooves 133 are not being blocked but exposed from the trigger 210, such that the first assembly shaft 91 and the second assembly shaft 92 of the photosensitive assembly 9 are able to be respectively disposed into the second guide groove 133 and the first guide groove 132 through the third guide grooves 222 of the stopper 220.

In this embodiment, the image forming apparatus 1 further includes two return springs 40. Each return spring 40 is, for example, an extension spring, and is connected between the side plate 130 and the stopper 220. Therefore, the return spring 40 constantly applies force to pull the stopper 220 toward the trigger 210 so as to force the fixing mechanism 20 to move toward the releasing state. As such, constantly, the return spring 40 forces the stopper 220 to press against the pushing end 212 of the trigger 210 so as to force the engage end 211 of the trigger 210 to stick out past the top edge of the side plate 130. On the other hand, when a certain force is applied to the engage end 211 of the trigger 210 to pivot the trigger 210, the trigger 210 can push the stopper 220 so as to pull the return spring 40 to store energy in the return spring 40.

Then, please further refer to FIGS. 6-7 to explain the operation of the image forming apparatus 1.

First is to place the photosensitive assemblies 9 into the casing 10. In detail, to the photosensitive assembly 9 which is located relatively away from the cover lock 135, the first assembly shaft 91 is disposed through the third guide groove 222 of the stopper 220 from the top edge of the side plate 130 and then is disposed into the first guide groove 132 and stopped at the bottom surface 1321, and the second assembly shaft 92 is disposed through the straight portion 1331 of the second guide groove 133 from the top edge and then is disposed into the curved portion 1332 and stopped at the side of the curved portion 1332 away from the first guide groove 132. At this moment, the first assembly shaft 91 and the second assembly shaft 92 of the photosensitive assembly 9 respectively press against the guide surface 1322 of the first guide groove 132 and the curved portion 1332 of the second guide groove 133, thus the photosensitive assembly 9 is prevented from moving in a horizontal direction. Similarly, to the other photosensitive assembly 9, the first assembly shaft 91 and the second assembly shaft 92 are respectively disposed into the other first guide groove 132 and the other second guide groove 133 from the top edge of the side plate 130 and thus the other photosensitive assembly 9 is also prevented from moving in the horizontal direction. As shown in the figure, these photosensitive assemblies 9 are arranged along the long side of the side plate 130 (e.g., the direction D3 shown in FIG. 7).

Then, the cover plate 30 is pivoted to the closed position along the second direction D2, such that the hooks 310 on the cover plate 30 respectively hook the cover locks 135, and the press blocks 320 on the cover plate 30 respectively push the engage ends 211 of the triggers 210.

In more detail, during the movement of the cover plate 30 shown in FIGS. 6-7, the hook 310 and the cover lock 135 are in contact with each other with inclined surfaces and thus the cover lock 135 can force the hook 310 to pivot so that the hook 310 passes over the cover lock 135 and then hooks the cover lock 135 after the hook 310 returns to its original position. On the other hand, the press block 320 and the engage end 211 are also in contact with each other with inclined surfaces and thus the press block 320 is able to force the trigger 210 to pivot along the first direction D1 which is opposite to the second direction D2 so as to force the pushing end 212 of the trigger 210 to push the stopper 220 along the direction D3 via the contact inclined surface 221. Consequently, the third guide grooves 222 of the stopper 220 are offset from the second guide groove 133 and the first guide groove 132, such that the stopper 220 blocks the first guide grooves 132 and covers the bottom surfaces 1321. At this moment, the stopper 220 blocks at the top side of the first assembly shaft 91 of the photosensitive assembly 9 so as to retain the position of the first assembly shaft 91 between the fixing mechanism 20 and the bottom surface 1321, thereby preventing the photosensitive assembly 9 from moving vertically. As such, the photosensitive assembly 9 is restricted in all directions when the cover plate 30 is closed (i.e., when the cover plate 30 is in the closed position).

On the contrary, the photosensitive assembly 9 can be released by pivoting the cover plate 30 to the opened position along, for example, the first direction D1. During the movement of opening the cover plate 30, the press block 320 on the cover plate 30 is separated from the trigger 210, therefore the energy stored in the return spring 40 is released to force the stopper 220 to slide toward the trigger 210 so as to force the trigger 210 to pivot along, for example, the second direction D2. Consequently, the engage end 211 of the stopper 220 is forced to stick out past the top edge of the side plate 130, and the third guide grooves 222 of the stopper 220 are respectively aligned with one of the second guide grooves 133 and one of the first guide grooves 132, thereby exposing the second guide groove 133 and the first guide groove 132 from the top edge of the side plate 130. The so phrase "exposing the second guide groove 133 and the first guide groove 132 from the top edge of the side plate 130" means that the second guide grooves 133 and the first guide groove 132 can be seen through the top edge of the side plate 130. As such, the stopper 220 of the fixing mechanism 20 does not block the first assembly shaft 91 of the photosensitive assembly 9 therefore the photosensitive assembly 9 can be removed from the side plates 130.

Accordingly, by pivoting the cover plate 30, the fixing mechanism 20 can fix the photosensitive assemblies 9 in the desired positions or can release the photosensitive assemblies 9. The installation process of the photosensitive assembly 9 is simple and convenient. In comparison with the conventional image forming apparatus that the installation of the photosensitive assembly requires user to additionally screw the photosensitive assembly, the image forming apparatus 1 is much convenient in installing the photosensitive assembly, and there is no need to worry about forgetting to screw the photosensitive assembly and thus eliminating the potential of human error.

In the previous embodiments, the quantity of the photosensitive assemblies 9 that the image forming apparatus 1 can accommodate is plural, and these photosensitive assemblies 9 are arranged along a direction parallel to the long side of the side plate 130 or the direction D3 and can be fixed in position by the stopper 220, achieving a configuration that a single movement of the cover plate can simultaneously fix or release multiple photosensitive assemblies.

Furthermore, since the stopper 220 is slidable in a horizontal direction, the vertical distance between the stopper 220 and the photosensitive assemblies 9 is fixed during the movement of the stopper 220. That is, the stopper 220 provides the same restriction to each photosensitive assembly 9.

Lastly, in the above embodiment, the image forming apparatus 1 includes two fixing mechanisms 20 and two return springs 40 and other components in a pair, but the present disclosure is not limited thereto. For example, in some other embodiments, the image forming apparatus may only include one fixing mechanism and one return spring that are disposed on one of the side plate. In another embodiment, each side plate may only include one group of the first guide groove and the second guide groove, and the stopper may only include one third guide groove, thus, in such a case, the image forming apparatus may only able to accommodate one photosensitive assembly.

According to the image forming apparatus as discussed in above, the fixing mechanism can fix one or more photosensitive assemblies in position or release them by pivoting the over plate, which is simple in operation and convenient to user. Therefore, there is no need to worry about forgetting to screw the photosensitive assembly therefore eliminating the potential of human error.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. An image forming apparatus, configured for accommodating at least one photosensitive assembly having at least one first assembly shaft, comprising:

a casing, having at least one first guide groove, and the at least one first assembly shaft configured to be slidably disposed in the at least one first guide groove;

at least one fixing mechanism, movably mounted on the casing so as to be movable between a blocking state and a releasing state; and a cover plate, movably connected the casing so as to be movable between an opened position and a closed position;

wherein when the cover plate is moved to the closed position, the cover plate forces the at least one fixing mechanism to move to the blocking state to block the at least one first guide groove, cover a bottom surface of the at least one first guide groove and be located above the at least one first assembly shaft so as to retain the at least one first assembly shaft of the at least one photosensitive assembly between the at least one fixing mechanism and the bottom surface and prevent the at least one first assembly shaft from moving up and down; when the cover plate is moved to the opened position from the closed position, the movement of the cover plate allows the at least one fixing mechanism to move toward the releasing state from the blocking state so as to expose the at least one first guide groove of the casing.

2. The image forming apparatus according to claim 1, wherein the at least one fixing mechanism comprises a stopper and a trigger, the stopper is slidably disposed on the casing, the trigger is pivotally mounted on the casing, the trigger has an engage end and a pushing end opposite to each other, the pushing end constantly contacts the stopper, the engage end normally sticks out past a top edge of the casing; when the cover plate is moved to the closed position, the cover plate presses the engage end of the trigger to force the trigger to pivot so as to force the pushing end of the trigger to push the stopper to block the at least one first guide groove of the casing and cover the bottom surface of the at least one first guide groove, thereby retaining the at least one first assembly shaft between the at least one fixing mechanism and the bottom surface.

3. The image forming apparatus according to claim 2, wherein when the cover plate is moved to the opened position from the closed position, the cover plate is separated from the engage end of the trigger so as to enable the stopper to move and expose the at least one first guide groove.

4. The image forming apparatus according to claim 2, wherein the casing has at least one second guide groove, the stopper has at least one third guide groove, the at least one photosensitive assembly has at least one second assembly shaft which is configured to be disposed through the at least one second guide groove and the at least one third guide groove; when the at least one fixing mechanism is in the releasing state, the at least one second guide groove is aligned with the at least one third guide groove so that the at least one second guide groove is exposed through the at least one third guide groove.

5. The image forming apparatus according to claim 2, wherein the stopper has a contact inclined surface which is located on a side of the stopper facing the trigger and contacts the pushing end of the trigger; while the at least one fixing mechanism is moved from the releasing state, the pivot direction of the trigger is orthogonal to the contact inclined surface.

6. The image forming apparatus according to claim 2, wherein the pivot movement of the cover plate causes the pivot movement of the trigger and the slide movement of the stopper.

7. The image forming apparatus according to claim 2, wherein the cover plate is movable to the opened position from the closed position along a first direction so as to force the trigger to pivot along a second direction which is opposite to the first direction.

8. The image forming apparatus according to claim 2, wherein the cover plate has at least one press block which protrudes from the cover plate, the at least one press block is configured to press the engage end of the trigger of the at least one fixing mechanism so as to force the at least one fixing mechanism to move toward the blocking state when the cover is moved to the closed position.

9. The image forming apparatus according to claim 1, further comprising at least one return spring which is connected between the at least one fixing mechanism and the casing and configured to force the at least one fixing mechanism to move toward the releasing state.

10. The image forming apparatus according to claim 1, wherein the casing comprises a base plate and two side plates, the two side plates are respectively mounted at two opposite sides of the base plate so that the side plates and the base plate together form an accommodating space for accommodating the at least one photosensitive assembly, the quantity of the at least one fixing mechanism is two, and the two fixing mechanisms are respectively mounted on the two side plates.

* * * * *